US009016223B2

(12) United States Patent
Rohden

(10) Patent No.: US 9,016,223 B2
(45) Date of Patent: Apr. 28, 2015

(54) SHIP COMPRISING A VENTILATION DEVICE

(75) Inventor: Rolf Rohden, Aurich (DE)

(73) Assignee: Wobben Properties GmbH, Aurich (DE)

( * ) Notice: Subject to any disclaimer, the term of this patent is extended or adjusted under 35 U.S.C. 154(b) by 87 days.

(21) Appl. No.: 13/822,130

(22) PCT Filed: Sep. 6, 2011

(86) PCT No.: PCT/EP2011/065355

§ 371 (c)(1),
(2), (4) Date: May 17, 2013

(87) PCT Pub. No.: WO2012/034898

PCT Pub. Date: Mar. 22, 2012

(65) Prior Publication Data

US 2013/0220199 A1 Aug. 29, 2013

(30) Foreign Application Priority Data

Sep. 16, 2010 (DE) ..... 10 2010 040 913

(51) Int. Cl.
*B63J 2/08* (2006.01)

(52) U.S. Cl.
CPC ..... *B63J 2/08* (2013.01)

(58) Field of Classification Search
CPC ..... B63B 29/02
USPC ..... 114/72, 39.3, 211
See application file for complete search history.

(56) References Cited

U.S. PATENT DOCUMENTS

| | | | | | |
|---|---|---|---|---|---|
| 4,112,645 | A * | 9/1978 | Greenfield | ..... | 52/209 |
| 5,232,385 | A * | 8/1993 | Hatfield | ..... | 440/44 |
| 6,105,525 | A * | 8/2000 | Rapeli | ..... | 114/72 |
| 8,601,964 | B2 * | 12/2013 | Rohden | ..... | 114/39.3 |

FOREIGN PATENT DOCUMENTS

| | | | | |
|---|---|---|---|---|
| BE | 684627 | A | 1/1967 | |
| CN | 1660666 | A | 8/2005 | |
| DE | 17996 | C | 5/1882 | |
| EP | 0 260 624 | A1 | 3/1988 | |
| GB | 871231 | A | 6/1961 | |
| GB | 2 007 819 | A | 5/1979 | |
| GB | 2007819 | A * | 5/1979 | ..... B63J 2/12 |
| JP | 55-165900 | A | 11/1980 | |
| JP | 60-73699 | U | 5/1985 | |
| JP | 4-122293 | U | 11/1992 | |
| JP | 2006-036118 | A | 2/2006 | |
| JP | 2008-543641 | A | 12/2008 | |
| WO | 2006/133950 | A2 | 12/2006 | |

* cited by examiner

*Primary Examiner* — Lars A Olson
*Assistant Examiner* — Jovon Hayes
(74) *Attorney, Agent, or Firm* — Seed IP Law Group PLLC

(57) ABSTRACT

The invention concerns a ship comprising at least one hold, and at least one ventilation apparatus for ventilation of the hold, which has at least one air inlet and at least one air outlet connected to the air inlet by means of a passage. In particular the invention concerns a ship having a ventilation apparatus, wherein the passage has at least one portion arranged above the air inlet. The invention further concerns a ventilation apparatus for ventilation of the hold of a ship.

21 Claims, 4 Drawing Sheets

SHIP COMPRISING A VENTILATION DEVICE

BACKGROUND

1. Technical Field

The invention concerns a ship comprising at least one hold, and at least one ventilation apparatus for ventilation of the hold, which has at least one air inlet and at least one air outlet connected to the air inlet by means of a passage.

The invention further concerns a ventilation apparatus for a ship

2. Description of the Related Art

In ships, for example cargo ships, ventilation represents a problem as the ships are generally very densely loaded with cargo and have little space for ventilation. That is problematical in particular in a closed cargo hold. As the hull of a ship should have as few openings as possible to prevent water from passing into the ship, ventilation is made still more difficult.

Nonetheless ventilation of a cargo hold is frequently desirable and for example absolutely necessary when transporting hazardous goods. For that purpose conventional ships frequently have a plurality of perpendicularly rising pipes which extend from a hold to the deck and extend out of the deck.

With such a pipe arrangement, the intake of water through the ventilation represents a problem. Conventional ventilation pipes which are guided on the deck are for that purpose frequently closed with a cover or the air inlet or outlet is angled to prevent rain water from passing thereinto. Nonetheless it is possible that, when the deck is awash with water, flood water can pass into the ventilation and thus also into the hold. Many ventilation systems have complicated valve structures which however are maintenance-intensive and susceptible to trouble, in particular because of the salty sea water.

If a plurality of those ventilation openings are arranged on deck of a ship, for example a cargo ship, such as for example a container ship, efficiently loading of the deck with cargo can also be hindered.

As general state of the art attention is directed to DE 17996 A.

BRIEF SUMMARY

One or more embodiments of the present invention is to provide a ship having an improved ventilation apparatus.

In a ship according to an embodiment of the invention the air for ventilation of a hold is passed through an air inlet into a ventilation passage. That passage has a portion arranged above the air inlet. Here the term above is to be interpreted as meaning that, when the ship is in an upright position, the portion is arranged substantially above the air inlet. According to an embodiment of the invention rain water is prevented from passing through the ventilation apparatus into the hold. That is also made considerably more difficult for flood water as that water must firstly pass through the portion of the passage, which rises up out of the air inlet.

The passage here can be any kind of passage. In particular it is immaterial whether the passage is of the same cross-section in each portion thereof. It is also not restricted to a cross-sectional geometry. If the ship has a plurality of those ventilation apparatuses, then it is in accordance with the invention for the corresponding passages also to be of a differing configuration. That is advantageous as the structural ambient conditions or also the ventilation functions to be performed within a ship can vary.

A ventilation apparatus preferably has a plurality of air inlets and a plurality of air outlets. In that way it is possible for example for air to be received in the passage at two smaller air inlets and to be discharged through the air outlets at various locations in the ship. In addition it is preferred for the passage to have an air inlet and a plurality of air outlets. In an alternative embodiment the passage has only one air inlet and one air outlet.

In a preferred embodiment at least one air inlet is arranged in a lateral outer portion of the ship.

That permits in particular efficient utilization of the deck surface area. The fact that the air inlets do not extend through the deck means that cargo can be more efficiently stored on the deck surface. It is advantageous for the air inlet to be arranged in a portion as far away as possible from the surface of the water. The portion arranged above the air inlet is preferably disposed within the ship. Alternatively the portion arranged above the air inlet is arranged outside the ship. Outside here means that the passage extends over the deck. In addition, the lateral arrangement makes it considerably more difficult for water, in particular rain water, to enter. It is not necessary to provide a cover or the like.

For that purpose for example the passage is screwed, welded or the like from the inside to the outside wall of the ship, extends outwardly through the wall of the ship or in some other fashion has access to ambient air. For that purpose the wall of the ship preferably has an opening. Preferably the air inlet is additionally protected with a grill or a similar device. Alternatively it is also in accordance with the invention for the outside wall to form the grill insofar as a plurality of holes is provided in the outside wall so that the air can pass through the holes into the passage.

In a further preferred embodiment the air outlet or outlets are arranged in a shaft portion of the passage, which extends in a falling configuration, such as downwards, from the portion arranged above the air inlet.

The shaft portion is so arranged that the air used for ventilation passes into the corresponding hold. In that arrangement the shaft portion extends substantially in a falling configuration, advantageously substantially perpendicularly. Viewed from the air inlet, the shaft portion is arranged downstream of the portion disposed above the air inlet. Thus water is prevented from passing into the shaft portion and through same into the hold. The shaft portion does not have to be steadily falling in the mathematical sense. In accordance with an embodiment of the invention for the shaft portion to extend in a winding shape, for example a S-shape or in some other fashion. In accordance with another embodiment of the invention the passage has branchings therefrom.

In a further preferred embodiment the shaft portion is arranged at least partially in or adjoining the at least one hold and the air outlet or outlets open into the at least one hold.

Insofar as the shaft portion extends adjoining the hold the utilization of space in the hold is further improved. In that respect the air outlets open into the hold and thus permit ventilation. Advantageously the air outlets open into the hold in flush relationship. In that case the mouth opening can be designed in the most widely varying ways. Advantageously the shaft portion is passed laterally beside the hold or in a ceiling of a hold.

In a further preferred embodiment the ship has a main deck and the passage is arranged at least partially above the main deck.

Here it is not necessarily the uppermost deck that is to be understood as the main deck. In cargo ships for example the main deck is generally arranged between the outside wall of the ship and the opening of the hold.

If the passage is arranged at least partially above the main deck then the portion arranged above the air inlet is advantageously further spaced from the air inlet than in an embodiment in which the portion is passed beneath the main deck. That leads to a further increase in the safeguard against water passing into the passage.

Advantageously a hatch coaming is arranged between the main deck and the hold so that the portion arranged above the air inlet is over the hatch coaming or passes through same. A hatch coaming affords additional protection against water passing into the hold. If the portion arranged above the air inlet is arranged as described, it is further spaced from the air inlet and thus provides a better safeguard against water entering.

Preferably the shaft portion then extends from the hatch coaming into or beside the hold. In that way the hatch coaming is not interrupted at any location and affords effective protection against the entry of water.

In a further preferred embodiment the passage is substantially of a configuration corresponding to an inverted U.

If the passage is of such a configuration the arcuate portion of the U represents the portion arranged above the air inlet. One limb of the U goes into the at least one air inlet while the other limb goes into the at least one air outlet. In that case there is no need for the limbs to be of the same length. It is even advantageous to provide different lengths so that it is possible for the air outlet or outlets to be arranged beneath the at least one air inlet.

The shape only substantially corresponds to a U. Alternatively it is also similar to an inverted V or an inverted W. Those shapes are to be provided according to respective structural ambient conditions and ventilation functions to be performed.

If the ship has a main deck it is preferable for the passage to be passed over the main deck in an arcade shape.

In a further preferred embodiment the ventilation apparatus has means for conveying the air between the at least one air inlet and the at least one air outlet.

Those means include for example fluid energy machines, in particular fluid flow machines such as for example propellers, fans, turbines or pumps. Insofar as the ventilation apparatus has those means, it is possible according to the invention for air to be conveyed in specifically targeted fashion for ventilation of the hold from the air inlet to the air outlet or for venting air from the hold from the air outlet to the air inlet. A further advantage is afforded by the volume flow conveyed by the passage being adjustable by way of the conveying means. Thus under some circumstances it is preferable to convey a small volume flow while under other conditions it is preferable to convey a large volume flow. It is also possible according to an embodiment of the invention in that way to use different passages for ventilation or for venting air in a specific fashion.

In a further preferred embodiment the ship has a plurality of air outlets and the means for conveying the air are adapted to respectively independently convey air to the air outlets.

That is advantageous when the ship has various holds. It is thus possible in accordance with an embodiment of the invention to use the various holds to store different kinds of freight which make it necessary to separately ventilate the holds. It is also according to an embodiment of the invention for different holds to be supplied with different volume flows.

Preferably the means for conveying the air have automatic actuating devices which automatically provide for ventilation or air venting of the hold. Control of the ventilation apparatus is then to be operated from the bridge, from an engine room, or from another control room. Alternatively those means are provided with separate time switches so that ventilation takes place at regular intervals.

In a further preferred embodiment the ventilation apparatus has means for treating the air.

The term treating is intended here to denote that the air is for example influenced physically, chemically or physiologically according to any requirements. That includes for example: heating, cooling, drying, humidifying, desalinating, desulphurizing, filtering, cleaning, enrichment with oxygen, enrichment with other gases or substances, toxically cleaning etc.

Alternatively those means are also to be operated automatically. The means then preferably have detection devices or the like. That is advantageous in particular when toxic substances are loaded in the hold and the air which is discharged from the hold has to be suitably cleaned.

In a further preferred embodiment the ventilation apparatus has means for removing water from the shaft.

In that way it is possible according to an embodiment of the invention to remove any water which should pass into the passage in spite of the portion of the passage that is arranged above the air inlet. Such means include for example pumps, drains or the like. It is also advantageous to arrange a discharge flow device for water beneath an air inlet so that that water can flow directly into the sea again. Alternatively such a discharge flow device is arranged in or at the shaft portion.

In a further preferred embodiment the passage and/or the air inlet and/or the air outlet are reversibly closable.

A number of advantages are achieved by the passage and/or the air inlets and/or air outlets being reversibly closable. On the one hand it is possible to close off certain air inlets and/or air outlets to prevent air from passing therethrough. That is advantageous if the ship has a plurality of holds which are to be ventilated differently. On the other hand, closure is advantageous in relation to any entry of water, for example due to damage to the ship or due to a very high swell. In addition or alternatively the closure devices also have detection devices so that the passage is closed automatically in the case of entry of water. When the high swell which led to the entry of water has died away, it is possible for the passages and/or inlets and/or outlets to be opened again.

Preferably for example flaps which are pivoted in front of the outlets are used here as the closure devices. Alternatively horizontal or vertical bulkheads are to be provided. In a further alternative, apertures in the manner of an optical aperture or pivotable closure disks in the manner of a keyhole cover are to be provided.

In a further preferred embodiment the passage has one or more accesses or access points.

The accesses serve to perform maintenance operations and/or repairs or the like on the ventilation apparatus. The accesses are of different sizes. Alternatively all accesses are of substantially identical configuration. The accesses can be very small so that a human hand can pass therethrough or they can also be larger so that they correspond to manholes and allow people to enter the passage. The accesses are advantageously to be closed in water-tight and air-tight fashion. Alternatively they are of a design configuration corresponding to hatches, doors or the like.

Further advantageously the accesses are to be arranged adjacent to the above-described means for conveying the air, for treating the air and for removing water from the passage. That substantially facilitates maintenance and/or repair of those means. It is also in accordance with an embodiment of the invention to provide an access for each means.

In a further preferred embodiment a ladder is arranged at or in the passage.

In that case the ladder is arranged substantially along an axial direction in which the passage extends. In an alternative it is arranged at a wall portion adjacent to the passage so that it is possible without any problem to reach even accesses which are not within reach from a floor.

A particularly advantageous embodiment according to the invention is one in which the ladder is arranged in the passage, in combination with an access to the passage, which is in the form of a manhole. In that way it is possible also to use the passage as an emergency escape. That advantageously influences the safety of the ship according to an embodiment of the invention.

In a further preferred embodiment the boundaries of the passage are integrated into walls of the ship so that the passage and an inside or outside region of the ship have common walls.

If the passage extends along a wall of the ship it is in accordance with an embodiment of the invention and advantageous for the passage to be integrated into the wall and not just arranged beside the wall. Material and weight are saved by the wall of the ship at the same time forming a lateral boundary of the passage.

In a further preferred embodiment the main deck of the ship has a substantially closed cover which goes into, adjoins, or merges with, the outside wall of the ship.

With such a cover, the wind which provides an afflux flow to the ship is better diverted over the ship. That is particularly advantageous when the ship is in the form of a sailing ship, for example with sailing, Flettner or Magnus rotors. In that case the cover terminates flush with the hold opening and then passes in an arcuate configuration into the wall of the ship. All transitions advantageously have no edges or angular bulging portions so as not to adversely influence a flow. In that case the hold opening is advantageously arranged as far as possible above the main deck so that people can move on the main deck in a position of standing upright.

In a further preferred embodiment the passage is arranged within the outside wall of the ship.

It is advantageous for the passage to be passed along the inside of the cover over the main deck. That provides the largest possible spacing between the air inlet and the portion arranged above the air inlet. Such an embodiment affords a high level of safeguard against the entry of water and avoids passage portions which are passed over a cargo deck and which are a nuisance.

Alternatively or additionally access openings are provided in the passage which is passed over the main deck so that the passage is comfortably accessible from the main deck.

In a further preferred embodiment the ship is in the form of a double-wall ship having an outer wall and an inner wall and the portion of the passage, that extends from the air inlet to the portion arranged above the air inlet, is arranged at the outer wall and the shaft portion of the passage is arranged at the inner wall.

Most modern ships are of a double-wall structure. That substantially increases the safety of the ship. With such a mode of construction the portion of the passage, that extends from the air inlet to the portion arranged above the air inlet, is preferably arranged at the outer wall. The shaft portion is correspondingly preferably at the inner wall. In the case of a possible leak in the outer wall of the hull that has the advantage that the shaft portion is not damaged and no water passes into the hold through the ventilation apparatus. Such an arrangement is further advantageous as it substantially facilitates installing a plurality of air inlets and outlets.

An embodiment of the invention is a ventilation apparatus for ventilation of the hold of a ship, comprising at least one air inlet and at least one air outlet connected to the air inlet by means of a passage, wherein the passage has at least one portion arranged above the air inlet.

The use of such a ventilation apparatus in other ships is also in accordance with an embodiment of the invention. The use of a ventilation apparatus as described hereinbefore is advantageous not only in ships of the kind set forth in the opening part of this specification, but also in relation to other cargo ships, container ships and mixed cargo ships.

BRIEF DESCRIPTION OF THE SEVERAL VIEWS OF THE DRAWINGS

The invention is described hereinafter by means of embodiments by way of example with reference to the accompanying drawings in which.

DETAILED DESCRIPTION

Figure 1:
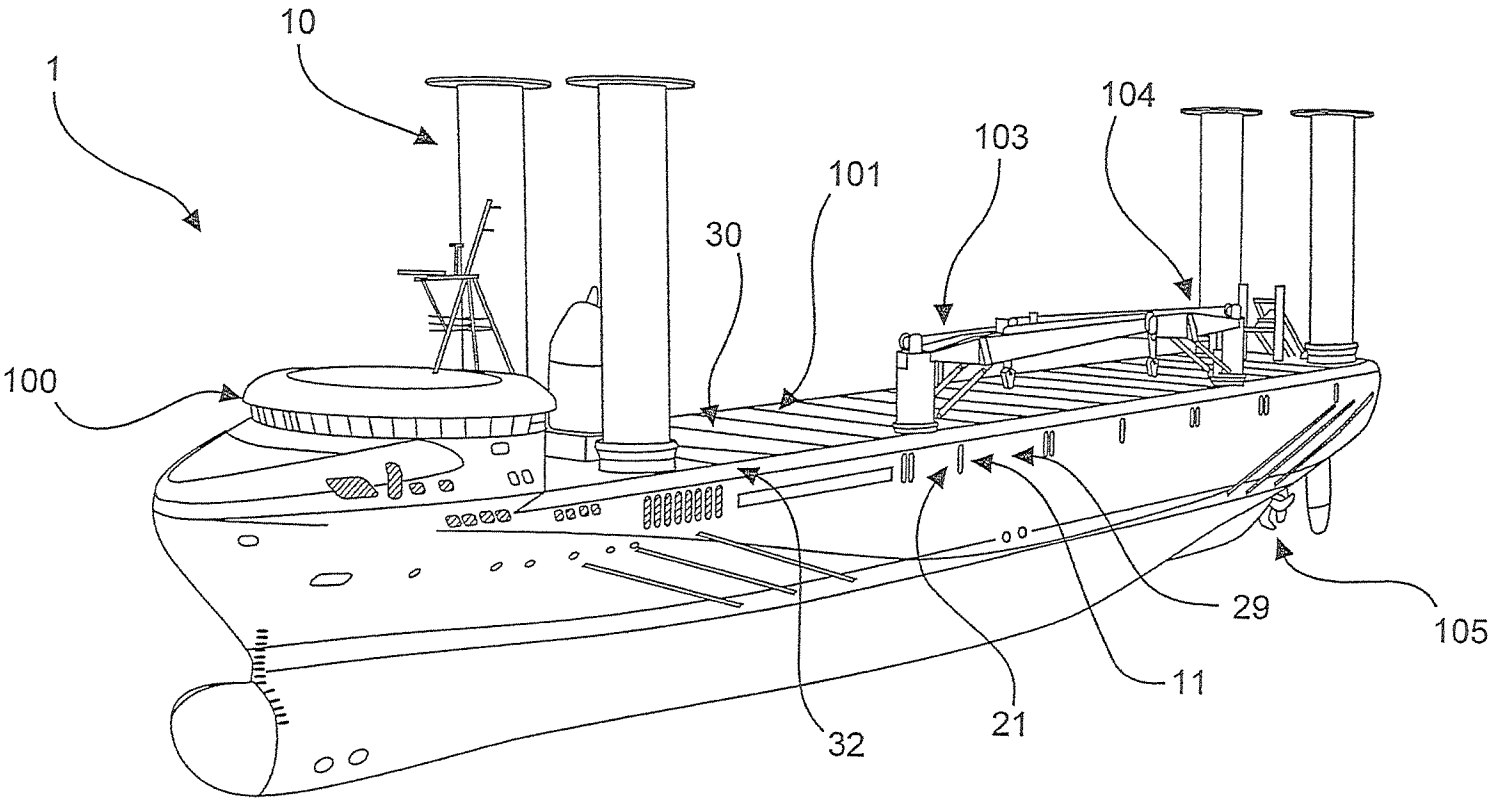
FIG. 1 shows a perspective view of a ship according to the invention.

The ship 1 according to the invention as shown in FIG. 1 has four Magnus rotors 10 and a ship's propeller 105 as the drive. Magnus rotors are also referred to as Flettner rotors or sailing rotors. They are arranged in a rectangle substantially at the four corners of the hold. The bridge 100 is also arranged in a forward portion of the ship. Two cranes 103, 104 are arranged on the deck 101 which is closed with a cover 30. In this embodiment on the port side the ship 1 has a plurality (19 are shown here) of ventilation apparatuses 11 (only one is provided with a reference numeral). The air inlet 21 is positioned in a lateral outer portion 29.

In the first embodiment (FIG. 2) the ship 1 has a hold which is sub-divided into two holds 5, 6 arranged one above the other. The holds 5, 6 are separated from each other by a floor panel 50 of the hold 5. Depending on the respective configuration of that floor panel 50 and further framework conditions such as rising stairways or the like (not shown) the two holds 5, 6 are substantially air-tight relative to each other. In this case the air outlet 25 communicates with the hold 6 and the air outlet 27 correspondingly communicates with the hold 5. The air outlets 25, 27 are connected to the air inlet 21 by way of the passage 13. In this case the passage 13 is passed in part above the main deck 31. The passage 13 has three portions: a portion 17 arranged above the air inlet 21, a portion 15 connecting the air inlet 21 to the portion 17 arranged above the air inlet 21 and a shaft portion 19 which extends in a falling configuration, or downwards, from the portion 17 arranged above the air inlet 21. In that way the passage 13 is equal to an inverted U, wherein the one limb is substantially longer than the other.

Figure 2:
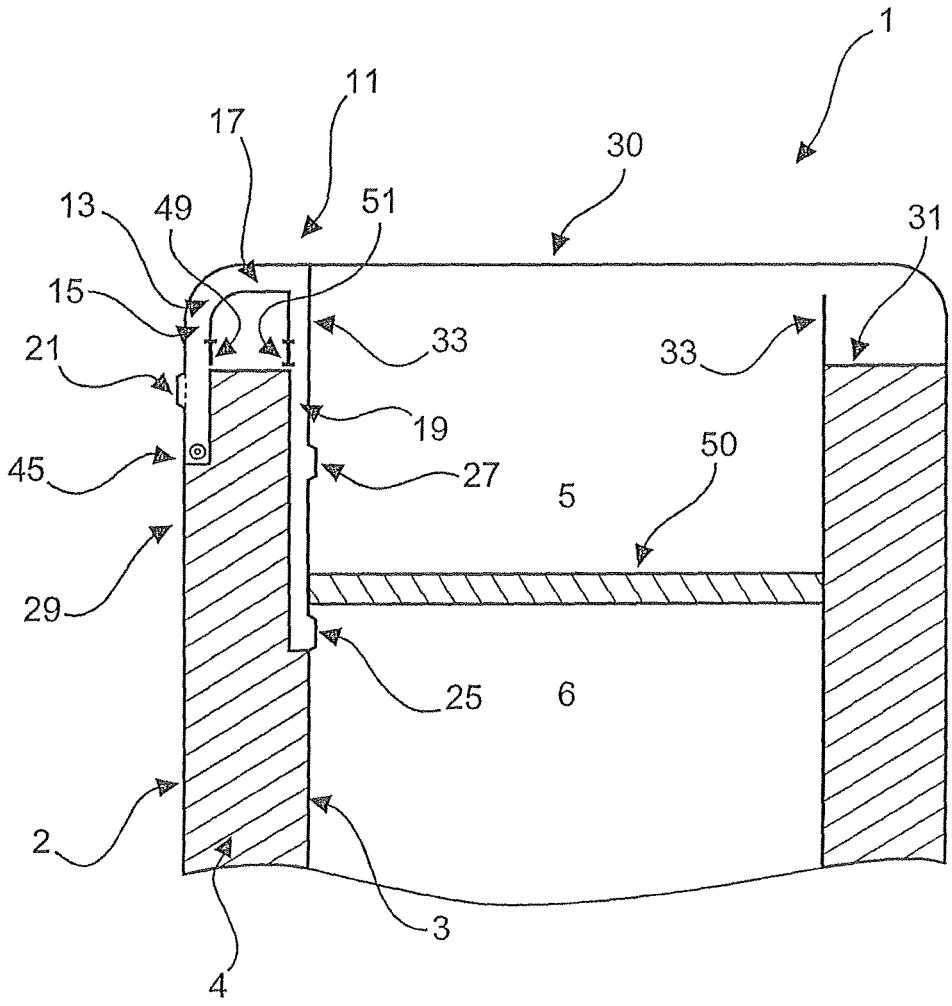
FIG. 2 shows a cross-section through an embodiment of the ship according to the invention.

In FIG. 2 the air inlet 21 is arranged slightly below the main deck 31 (which extends peripherally). An access 49 to the passage 13 is arranged in the proximity of that air inlet 21. The passage 13 does not terminate directly beneath the air inlet 21 but is extended downward somewhat further. A pump 45 is arranged in the passage 13 beneath the air inlet 21. Any kind of water which has passed for example through the air inlet 21 into the passage 13 can be removed by means of that pump. In the shaft portion 19 the passage 13 also has an access 51. The air outlets 25, 27 can be reached through that access 51.

The opening of the hold 5 is surrounded in this embodiment (FIG. 2) with a hatch coaming 33. The main deck 31 extends around the hold 5 between the outside wall 2 and the hatch coaming 33. The passage 13 extends to the upper edge of the hatch coaming 33 and from there passes in a falling configuration in the direction of the holds 5, 6. The main deck 31 and the hold 5 are covered with a cover 30. The passage 13 is arranged within that cover. In other words, it extends at the inside of the outside wall 2 and the cover 30 as far as the hatch coaming 33 and from there in a falling configuration in the direction of the holds 5, 6. In that case the passage 13 extends in an arcade shape over the main deck 31.

Here (FIGS. 2-4) the ship 1 is in the form of a double-wall ship. It has an outside wall 2 and an inside wall 3. Arranged between those walls is the ballast tank 4 which serves to increase the stability of the ship 1 at sea. In this case the portion 15 is respectively arranged at the outside wall 2 (FIG. 2) while the shaft portion 19 is arranged at the inside wall.

Figure 3:
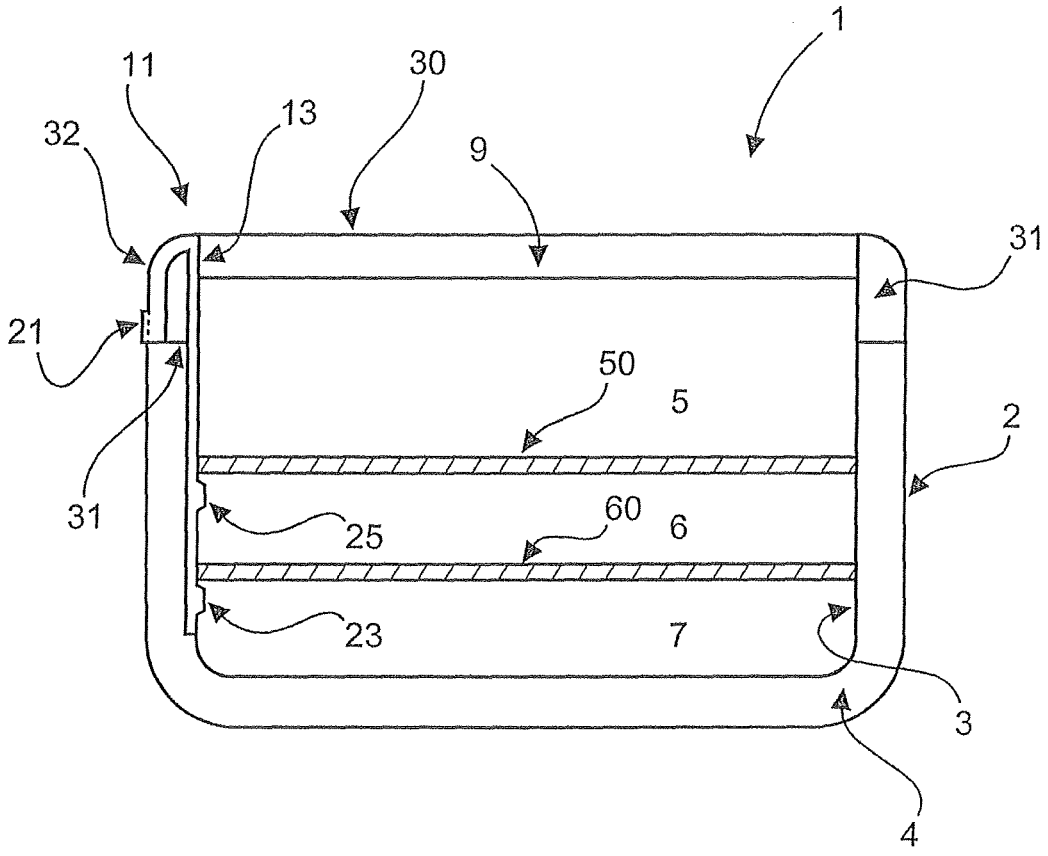
FIG. 3 shows a further cross-sectional view of an embodiment of a ship according to the invention.

In the embodiment shown in FIG. 3 the ship 1 has three holds 5, 6, 7 which are arranged one above the other and which are separated from each other by the floor panels 50, 60. In addition beneath the cover 30 the ship 1 has a weather deck 9 which is exposed when the cover 30 is opened. The cover 30 contributes to guiding the afflux flow of wind past the Magnus rotors 10 (FIG. 1). In that arrangement the cover 30 goes into the outside wall 2 of the ship 1. The transition 32 is smooth and without edges or projections.

In this embodiment also (FIG. 3) the ventilation apparatus 11 has a passage 13 of a U-shaped configuration. Here the air inlet 21 is arranged at the height of the main deck 31. That permits better access. Here (FIG. 3) a respective air outlet 23, 25 is provided only for the holds 6, 7. Thus a ventilation apparatus 11 supplies only the two holds 6, 7. A separate ventilation apparatus (not shown) is provided for the uppermost hold 5. Alternatively the hold 5 is ventilated by way of the weather deck (this is not shown). Such a configuration of the invention is advantageous if a different load which is not to be in communication by way of the ventilation apparatus is stored in the holds. In this embodiment also (FIG. 3) the ship 1 is of a double-walled structure having an inner wall 3 and an outer wall 2. The ballast tank 4 encloses the holds 5, 6, 7 from below and is arranged between the two walls 2, 3.

Figure 4:
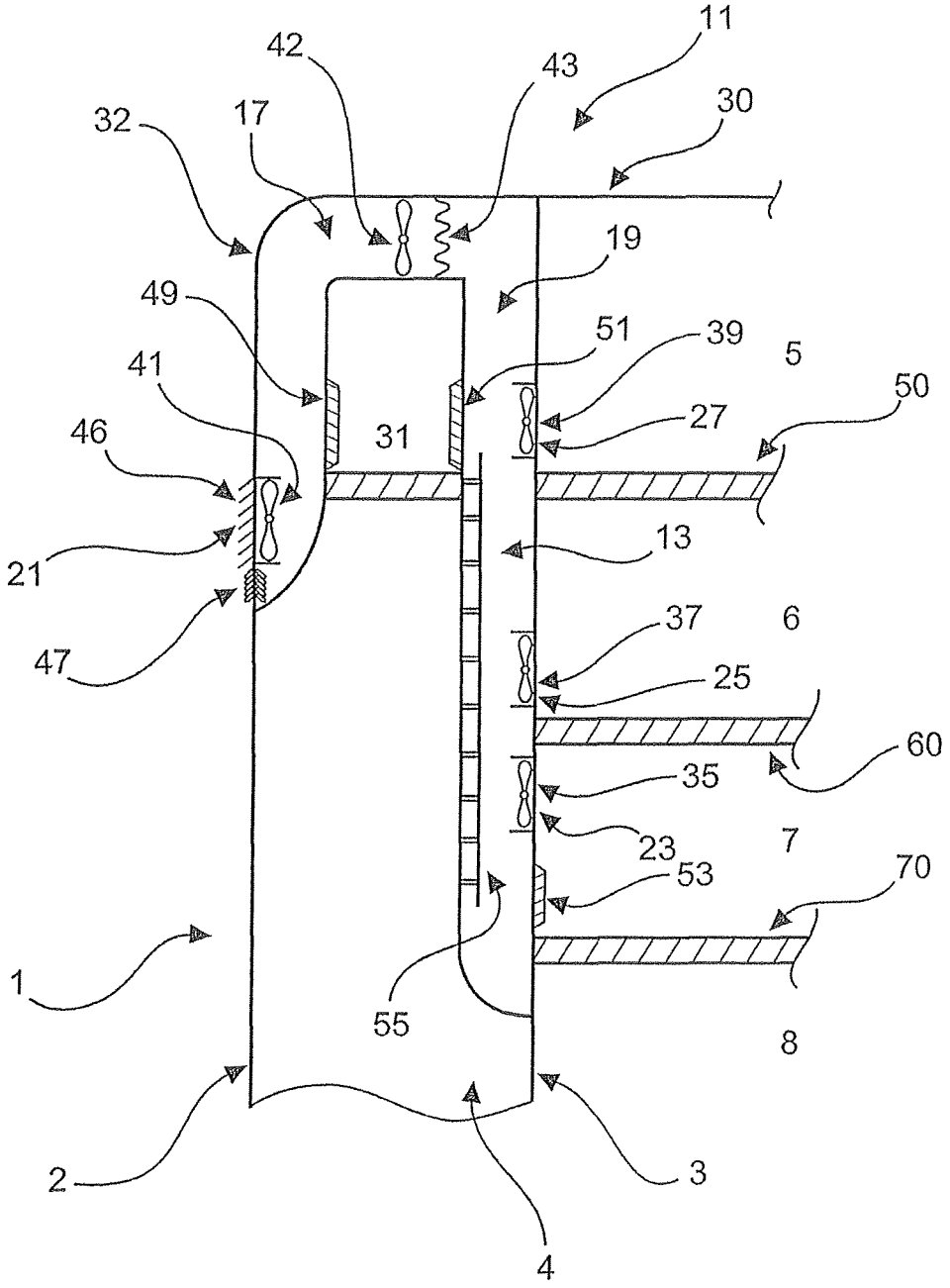
FIG. 4 shows a further cross-sectional view of a further embodiment of a ship according to the invention.

FIG. 4 shows a further embodiment. In this respect the shape and arrangement of the ventilation apparatus 11 is substantially the same as that of the previous embodiments of FIGS. 2 and 3. In this embodiment the ship 1 has four holds 5, 6, 7, 8 which are arranged one above the other and which are separated from each other by floor panels 50, 60, 70. The ventilation apparatus 11 has an air inlet 21 and an air outlet 23, 25, 27 for the uppermost three holds. The lowermost hold 8 can be ventilated and vented by way of a further ventilation apparatus (not shown). Fans 35, 37, 39, 41 are arranged in a through-flow portion of the air inlet and outlets. The fans serve to produce flow in the passage 13. In addition, arranged in the portion 17 above the air inlet 21 is a fan 42 which further promotes the production of flow. A heating element 43 is arranged beside the fan 42. The heating element serves to heat the air flowing through the passage 13. That is advantageous if the temperature of the outside air is low but the load in the holds 5, 6, 7 is to be transported for example at room temperature.

The air inlet 21 in the FIG. 4 embodiment is provided with a slat grill 46. That protects the passage 13 from the entry of water, in particular spray water. If nonetheless water should enter, for example due to a high swell, it flows out of the passage 13 into the sea again through the drain 47. The slat grill 46 can also serve to close the air inlet 41 by the slats being pivoted in front of the inlet 41.

Three accesses 49, 51, 53 are also arranged in the passage 13 (FIG. 4). In that case the accesses 49 and 51 are to be reached from the main deck 31 and the access 53 correspondingly from the hold 7. A ladder 55 is arranged therebeside within the passage 13. The passage can thus also be used as an emergency exit. For that purpose it is advantageous for at least the access 51, 53 to be in the form of manholes.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A ship, comprising:

a hull having an outside surface; a main deck; a plurality of holds; and at least one ventilation apparatus for ventilating the plurality of holds, the ventilation apparatus having at least one air inlet and a plurality of air outlets in fluid communication each other by a passage, the air inlet being arranged on the outside surface of the hull just below the main deck, the plurality of air outlets placing the plurality of holds, respectively, in fluid communication with the passage, the passage having at least one portion arranged above the air inlet, wherein the at least one ventilation apparatus includes a means for conveying the air received by the air inlet through the passageway and to the plurality of air outlets, wherein the means for conveying air is configured to independently convey air to each of the plurality of outlets.

2. The ship according to claim 1 further comprising a lateral outer portion that is lateral to the at least one hold, wherein the ventilation apparatus is arranged in the lateral outer portion of the ship and the air inlet is configured to receive air and water that is external to the ship.

3. The ship according to claim 1, wherein the passage has a shaft portion, wherein the plurality of air outlets are arranged in the shaft portion, the shaft portion extending downwards from the at least one portion arranged above the air inlet.

4. The ship according to claim 3 wherein the shaft portion is arranged adjacent to the at least one hold, and the plurality of air outlets are openings into the holds, respectively.

5. The ship according to claim 1 further comprising a main deck, the passage being arranged at least partially above the main deck.

6. The ship according to claim 1 wherein at least one of the passage, the air inlet, and the plurality of air outlets are reversibly closable.

7. The ship according to claim 1 wherein the passage has one or more access points.

8. The ship according to claim 5 wherein the main deck of the ship has a substantially closed cover that adjoins an outside wall of the ship.

9. The ship according to claim 8 wherein the passage is arranged within the outside wall of the ship.

10. A ventilation apparatus for ventilating holds of a ship, the ventilation apparatus comprising;

an inlet in an outer surface of a hull of the ship, the air inlet being arranged on the outer surface of the hull just below a main deck of the ship, the inlet being configured to receive air from an environment external to the ship; a passage in fluid communication with the inlet; and a plurality of outlets in fluid communication with the inlet by the passage, the plurality of outlets configured to place the passage in fluid communication with a plurality of holds, respectively, the passage having a first portion that extends upwardly from the inlet and a second portion that extends downwardly to the plurality of outlets.

11. The ventilation apparatus according to claim 10 further comprising means for conveying the air between the inlet and the plurality of outlets, wherein the means for conveying the air is configured to independently convey air to each of the plurality of outlets.

12. The ventilation apparatus according to claim 10 wherein the passage is one of an upside down U-shaped, V-shaped, or W-shaped between the inlet and air plurality of outlets.

13. The ventilation apparatus according to claim 10 wherein the inlet is configured to receive water from an environment external to the ship, the ventilation apparatus further comprising a drain located below the inlet configured to drain water received through the inlet.

14. The ventilation apparatus according to claim 10 further comprising a grill with slats located at the inlet, the grill being configured to reduce the amount of water from entering the inlet.

15. The ventilation apparatus according to claim 10 further comprising a fan in the passage.

16. A method for ventilating a hold of a ship, the method comprising:

receiving air through an inlet located on an outer hull of a ship, the inlet being arranged on the outer surface of the hull just below a main deck of the ship; receiving water through the inlet; allowing the air to travel upwards through a first passage and downwards through a second passage to an air outlet;

passing the air through the outlet into a hold of the ship; and removing water received through the inlet through a drain.

17. The method according to claim 16 wherein the first and second passages are located in the outer wall of the ship.

18. The method according to claim 16 wherein:

allowing the air to travel upwards through the first passage and downwards through the second passage to the air outlet comprises allowing the air to travel upwards through the first passage and downwards through the second passage to a plurality of air outlets, the plurality of air outlets being in fluid communication with a plurality of holds, respectively; and passing the air through the outlet into the hold of the ship comprises passing the air through the plurality of outlets into the plurality of holds of the ship.

19. The ship according to claim 7 wherein the plurality of holds are separated from each other by floor panels, the ship further comprising:

a drain located below the air inlet that is configured to allow water entering through the at least one air inlet to drain out of the passage; and a heating element configured to heat the air in the passage.

20. A ship, comprising:

a hull having an outside surface; a main deck;

a plurality of holds arranged one above the other and separated from each other by floor panels;

at least one ventilation apparatus for ventilating the plurality of holds, the ventilation apparatus having at least one air inlet and a plurality of air outlets in fluid communication each other by a passage, the air inlet being arranged on the outside surface of the hull just below the main deck, the plurality of air outlets placing the plurality of holds, respectively, in fluid communication with the passage, the passage having at least one portion arranged above the air inlet, wherein the at least one of the air inlet and the plurality of air outlets are reversibly closable, wherein the passage includes one or more access holes and a ladder arranged in the passage; a drain located under the at least one air inlet and configured to allow water that enters the passage to drain out; a plurality of fans located in the ventilation apparatus and configured to convey air in the passage to the plurality of outlets; and a heating element located in the passage of the ventilation apparatus and configured to heat the air in the passage.

21. The ship according to claim 20, further comprising grills with slats, wherein at least one of the air inlet and the plurality of air outlets are reversibly closable by the grills.

* * * * *